United States Patent [19]

Metersky et al.

[11] Patent Number: 5,012,717

[45] Date of Patent: May 7, 1991

[54] AIR-TO-SUBSURFACE MISSILE SYSTEM

[75] Inventors: Morton L. Metersky, Warminster; James R. Howard, Huntingdon Valley, both of Pa.

[73] Assignee: The United States of America as represented by the Secretary of the Navy, Washington, D.C.

[21] Appl. No.: 402,060

[22] Filed: Sep. 29, 1964

[51] Int. Cl.[5] ..... B64D 1/04; F41F 5/00; F42B 19/46; F42B 22/44; F42B 25/00

[52] U.S. Cl. ..... 89/1.11; 114/21.1; 114/21.2; 114/21.3

[58] Field of Search ..... 114/21, 22, 20.1, 21.1, 114/21.2, 21.3; 340/2; 102/7; 89/1.11

[56] References Cited

U.S. PATENT DOCUMENTS 2,889,772 6/1959 Howard ..... 102/7
3,022,462 2/1962 Keiper ..... 340/2 X
3,088,403 5/1963 Bartling et al. ..... 114/22 X
3,230,500 1/1966 Dunn ..... 340/2 X

*Primary Examiner*—Deborah L. Kyle
*Assistant Examiner*—John W. Elwood
*Attorney, Agent, or Firm*—James V. Tura; James B. Bechtel; Susan E. Verona

[57] ABSTRACT

The invention is an air-to-subsurface missile system which has an acoustic homing torpedo and a directional sonobuoy held in the missile behind the torpedo by a cowling means which includes fins for aerodynamic stability. When the missile reaches the desired location in a body of water, the torpedo and sonobuoy are released. The sonobuoy has the ability to search for targets and to communicate both with the homing torpedo and with a tactical command station. Thus the torpedo can be guided to a target by the sonobuoy and command station, even at ranges at which the torpedo could not locate a target with its own homing system.

8 Claims, 2 Drawing Sheets

INVENTORS
MORTON L. METERSKY
JAMES R. HOWARD
BY
ATTORNEY

AIR-TO-SUBSURFACE MISSILE SYSTEM

The invention described herein may be manufactured and used by or for the Government of the United States of America for governmental purposes without the payment of any royalties thereon or therefor.

The present invention relates to air-to-subsurface missiles, and more particularly to air-to-subsurface missiles for use against high speed submarines and surface vessels.

Air-to-subsurface missile systems in the prior art have been used with only moderate success in anti-submarine warfare (ASW) missions. Detection and localization of submarines are now accomplished by several well-known search methods including radar (for snorkeling or surfaced submarines), sonar, MAD (magnetic anomaly detection), ECM (electronic counter measures), infrared, trail, photographic and visual. Having obtained the best possible submarine position or so-called target fix from one or more of these methods, an acoustic homing torpedo is launched from an aircraft or surface vessel near the target fix for attacking the submarine. The capabilities of this system are limited by such factors as the errors in the target fix obtained with existing search methods, the closing speed of the torpedo with respect to the target from launch until acoustical acquisition for homing, whether or not the submarine has been alerted, the stand-off range requirements and the submarine characteristics. These limitations have severely limited the usefulness of air-tosubsurface missiles in anti-submarine warfare to slow conventional submarines and surface vessels. High speed targets, such as nuclear-powered submarines, are able to escape from the acoustical acquisition range of existing types of acoustic homing torpedoes in the time interval or so-called "blind time" after obtaining the target fix until the torpedo is in the water and begins homing on the target. Thus, the probability of target acquisition by the torpedo using existing methods diminishes with the increasing speed capability of the target, and ultimately makes the missile system completely ineffective and useless against future generation submarines and surface vessels.

Accordingly, it is an object of the present invention to increase the probability of target acquisition of an air-to-subsurface missile even against the fastest submarines and surface vessels in existence and of future generations.

Another object of the invention is to provide an improved air-to-subsurface missile system especially suitable for use against missile launching or snorkeling submarines and lightly armed surface craft at relatively long stand-off distances under all weather conditions, which is lightweight and can be carried by existing anti-submarine aircraft, which has adequate target destruction capability, and which is compatible with existing and advanced anti-submarine warfare avionics systems.

Still another object of the invention is to provide a novel air-to-subsurface missile which can be launched from conventional aircraft, guided missiles or surface vessels to a position near a target fix, and which provides intermediate range target acquisition for guiding the missile until it comes within its terminal acquisition.

Still another object of the invention is to provide an improved air-to-subsurface missile system which effectively extends the target acquisition range utilizing well-known underwater sound principles and apparatus.

The foregoing objects of the invention, and other objects which will become apparent as the description proceeds, are achieved in the illustrated embodiment by providing an air-to-subsurface missile comprising, in combination, a directional sonobuoy and an acoustic homing torpedo which is launched from an aircraft into the water at a position corresponding to the last target fix obtained from underwater detection and localization apparatus and displayed at a TACO (tactical command) station in an aircraft or other convenient platform. Upon immersion, the sonobuoy-torpedo combination separates, and the torpedo automatically assumes a fixed orbit while the sonobuoy commences to transmit target position information back to the TACO station. Assuming that the target has escaped the acoustic acquisition range of the torpedo but that the sonobuoy, having relatively high sensitivity, maintains target contact, steering information is transmitted from the TACO station via the sonobuoy to the torpedo for directing it toward the target. When the torpedo comes within its own acoustic acquisition range, it begins to "home" on its own.

For a more complete and better understanding of the invention, reference will now be made to the accompanying drawing wherein.

Figure 1:
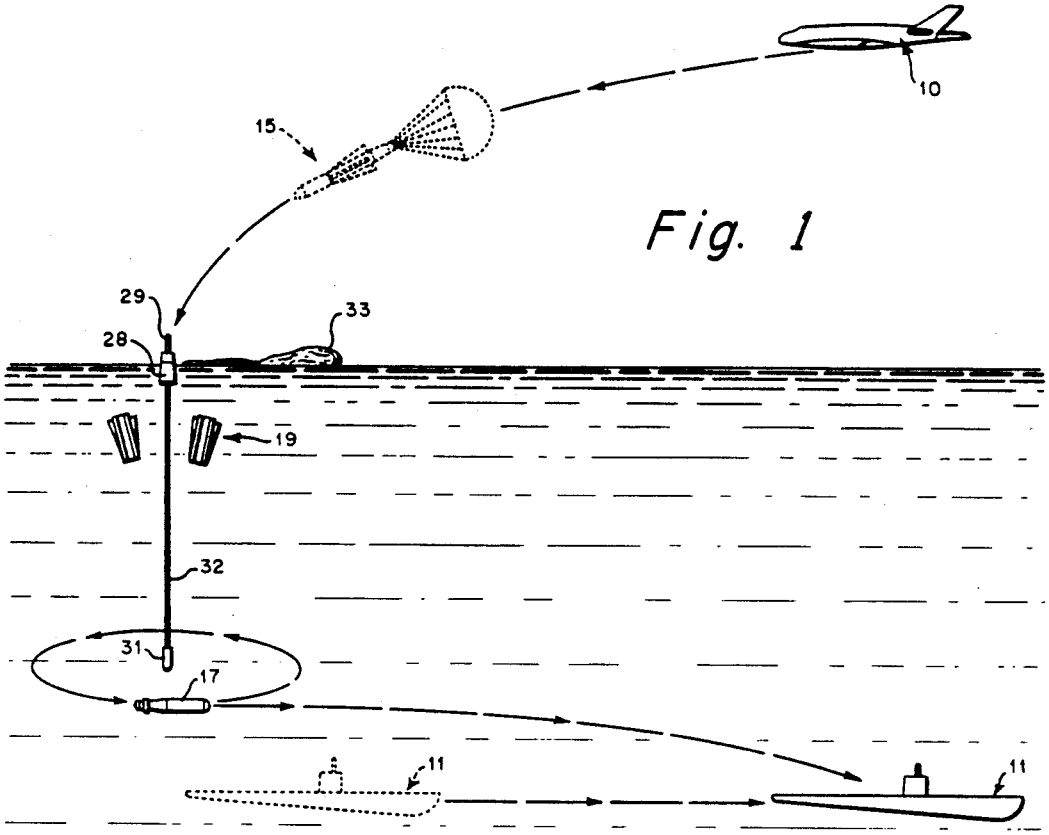
FIG. 1 represents in an elevation view, the operation of one embodiment of the air-to-subsurface missile system of the present invention as applied to a typical anti-submarine warfare mission.

Operation of one embodiment of the present invention as applied to a typical ASW (anti-submarine warfare) mission is shown in FIG. 1 wherein a TACO (tactical command) station 12 (FIG. 4) in an ASW patrol aircraft 10 has detected and localized a submerged submarine 11 and has obtained a target fix at the submarine position indicated in dotted outline. The target fix may be obtained by any one or more of the existing detection and localization methods mentioned previously. The search apparatus for accomplishing this is therefore simply shown in the TACO station 12 as a search unit 14 which displays the target position on a TACO geographical position display 13. Of course, the invention is not limited to any particular detection and localization technique, nor to locating the TACO station 12 in an ASW patrol aircraft. For example, future detection and localization techniques are also applicable, and the TACO station may be located on some other platform such as a remote aircraft or surface vessel, or even on land as conditions dictate. In the illustrated embodiment, an air-to-subsurface missile 15 is delivered to the target fix by the ASW patrol aircraft 10, the missile 15 being shown in dotted outline in descent, and in solid outline in subsequent operation. Where the TACO station 12 is on some remote platform, the missile 15 may be delivered to the target fix by other means such as a pilotless aircraft or rocket.

Figure 2:
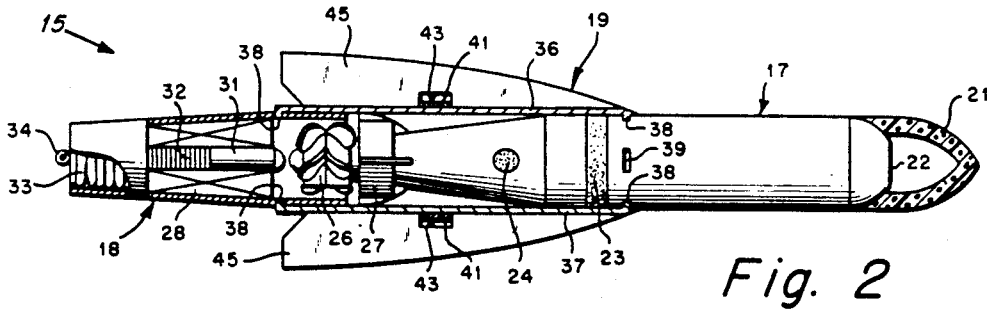
FIG. 2 represents a cut-away longitudinal view of the air-to-subsurface missile as applied in the ASW mission of FIG. 1.

The missile 15 is best described with reference to FIG. 2 in which it is shown ready for air launching. The missile 15 basically comprises a torpedo 17 and a sonobuoy 18 secured therebehind in tandem arrangement by jettisonable cowling 19.

The torpedo 17 is of the acoustic homing type such as disclosed in U.S. Pat. No. 3,021,807 for "Homing System for Torpedo", issued Feb. 20, 1964, by C. K. Stedman, which utilizes echo ranging underwater sound principles for guidance. It is understood that other types of acoustic homing torpedoes may be used without departing from the inventive concepts as herein described and claimed. The forward end of the torpedo 17 includes a frangible nose cone 21 having an aerodynamic profile suitable for high speed launching and for completely disintegrating on impact with the water surface. Upon disintegration, the nose cone 21 exposes a different forward profile suitable for high underwater speeds. The disintegration also exposes a nose transducer 22 mounted in the front which is used for acoustic homing of the torpedo in a manner to be described. The torpedo 17 further includes an omnidirectional transducer 23 circumferentially secured on the surface in a ring configuration at a convenient location along the length of the torpedo and another omnidirectional transducer 24 also conveniently secured to the torpedo surface. All of the transducers are flush with the adjacent outer surface of the torpedo to form thereby a smooth streamlined surface. The torpedo is propelled and guided by any conventional means such as counter-rotating propellor blades 26 and steering rudders 27, the latter being positioned by apparatus described in more detail hereinbelow.

The sonobuoy 18 includes an annular-shaped buoy 28 containing sonar transmitting and receiving equipment and an automatically erectable antenna 29 (FIG. 1). A directionally responsive hydrophone 31 and a cable 32, electrically connect between the buoy 28 and the hydrophone 31 are removably contained within the cylindrical opening in the buoy 28. In the assembled position shown, the cable 32 is wound into a small spool whereby the hydrophone 31 may be paid out in the manner shown in FIG. 1 after the torpedo 17 and the cowling 19 are separated from the sonobuoy 18. It is contemplated that the sonobuoy 18 be of the type presently available which is directionally responsive and of relatively high detection range capability as compared to the capability of presently available acoustic homing torpedoes. It is often necessary to retard the missile 15 to a terminal speed prior to entering the water in order to reduce impact and avoid deep submergence. The missile 15 therefore includes a drag chute 33 which is packed in a rear compartment of the sonobuoy 18. Upon launching, a rip cord 34 attached to the launching aircraft deploys the parachute 33, and by any conventional means not shown the parachute 33 is jettisoned when the missile 15 strikes the water.

Figure 3:
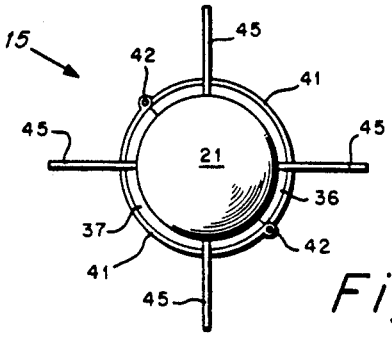
FIG. 3 represents a front view of the missile of FIG. 2.

In order to secure the torpedo 17 and the sonobuoy 18 in tandem arrangement and form thereby the missile 15, the cowling 19 comprises two elongated semicircular casings 36 and 37 (FIG. 3) having a plurality of tooth-like projections 38 at the ends thereof on the inner surfaces for registering with correspondingly spaced recesses 39 about the circumferences of the torpedo 17 and the sonobuoy 18 when the casings 36 and 37 abut one another along their side edges to form a substantially cylindrical enclosure between the torpedo 17 and sonobuoy 18. The casings 36 and 37 are securely held in the later position by as pair of straps 41 connected end-to-end about the mid section of the cowling 19 by a pair of releasable bolts 42. It is contemplated that the bolts 42 may be released at water immersion or by water impact by well-known apparatus not shown but which can be located on the missile 15 at any convenient location consistent with good design practice. The cowling 19 further includes a plurality of radical fins 45 projecting outward from the casings 36 and 37 to provide aerodynamic stability during descent to the water. Holes 43 in the fins 45 permit straps 41 to slide therethrough.

Figure 4:
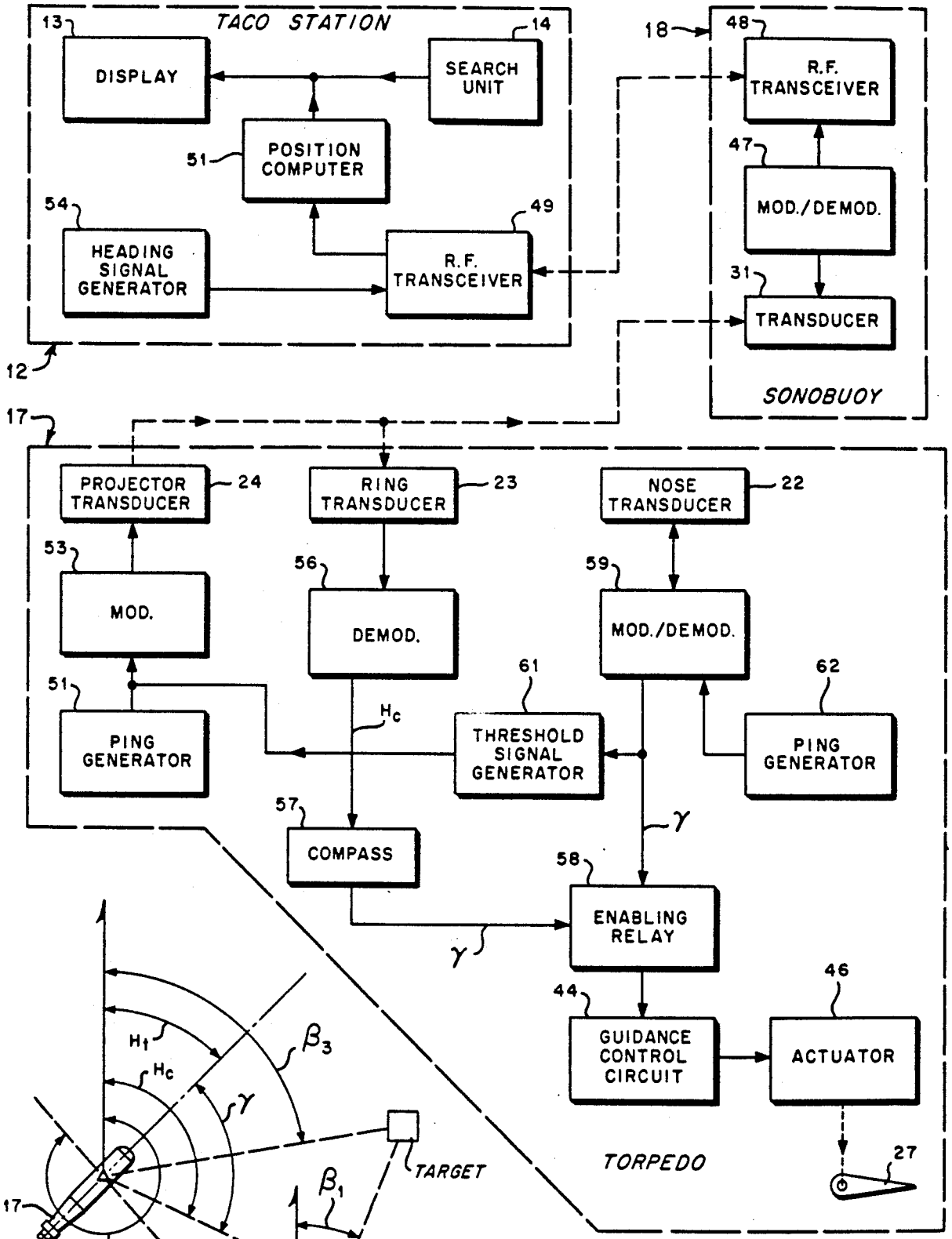
FIG. 4 is a block diagram of the radio-acoustic signal processors and controls as applied in the air-to-subsurface missile system of FIG. 1.
Figure 5:
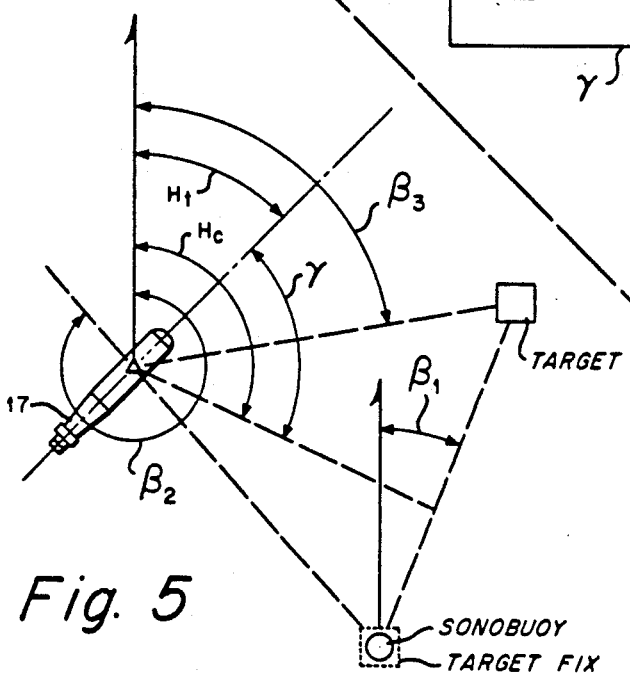
FIG. 5 illustrates the angular relationships necessary to an understanding of the operation of the present invention.

Referring now to FIG. 4, the geographical position of the sonobuoy 18 is indicated on the display 13 in a coordinate position corresponding to where the missile 15 is delivered. This position, of course, should also coincide with the initial target fix obtained by the search unit 14. For example, FIG. 5 shows a typical situation in which a circle symbolizes the sonobuoy position, a solid-line square the target submarine position and a triangle the torpedo position. The dotted-line square represents an earlier position of the target submarine when the initial target fix was obtained, the target submarine having moved to the position shown by the solid-line square. The sonobuoy 18, of course, is incapable of detecting the torpedo echo at any appreciable range. The invention therefore provides means described hereinbelow for clearly detecting and also distinguishing the torpedo from the target at all ranges. The torpedo 17 includes a conventional guidance control circuit 44 which is adapted to initially bias the rudders 27 through an actuator 46 into a fixed position for causing the torpedo 17 to orbit in the vicinity of the sonobuoy 18 until overriding steering information is received. The sonobuoy 18 must be directionally responsive, and preferably of the active type wherein range and bearing are obtained with echo-ranging sonar principles. Directional passive sonobuoys, of course, are also applicable without departing from the scope of the invention. Sonar signals representing bearing and range detected by the hydrophone 31 are modulated in the modulator/demodulator 47 for operating an RF transceiver 48 whose output is received in the TACO station 12 by an RF transceiver 49. A position computer 51 demodulates and resolves the range and bearing information for presentation on the display 13. As will be demonstrated hereinbelow, the invention is also capable of operation with target and torpedo bearing information alone, in which case only bearing lines from the sonobuoy circle need to be displayed.

The torpedo 17 is detected by means of a ping generator 52 which drives the projector transducer 24 at a discrete frequency through a modulator 53 at a constant pulse rate such as one pulse per second. The sonobuoy 18 transmits the torpedo 17 bearing to the TACO station 12 where it is clearly distinguishable on the display 13. With magnetic North being represented by the arrows N, the bearing $\beta_1$ from the sonobuoy to the target and the bearing $\beta_2$ from the sonobuoy to the torpedo are apparent on the display 13, and from this information a command heading $H_c$ is set in as heading signal generator 54 for a desired course to be taken by the torpedo 17. This setting may be done manually by the TACO operator or by conventional automatic computer means as desired. The command heading $H_c$ is transmitted through the RF transceiver 49 to the sonobuoy 18 where it is acoustically retransmitted to the omnidirectional ring transducer 23. The heading signal is then transformed by a demodulator 56 as an input to a compass computer 57. The computer compass 57 measures the heading $H_t$ of the torpedo 17 for subtracting from the command heading $H_c$ to yield an output signal of command steering angle $\gamma$ for the torpedo 17. The command steering angle $\gamma$ signal constitutes one of two inputs of an enabling relay 58. A signal at either input of the relay 58 will override the orbiting bias control to reposition the rudders 27 accordingly, and a signal from the compass computer 57 will override the other input signal of the relay 58.

It should now be apparent that the system may also be operated solely with bearing information from the sonobuoy whereas the TACO operator would first steer the torpedo 17 onto the target-sonobuoy bearing line. When the bearing $\beta_2$ coincides with the bearing $\beta_1$, the TACO operator would simply adjust the command heading $H_c$ to correspond to the bearings $\beta_1$ and $\beta_2$. This technique is preferred because the torpedo is usually orbiting in close proximity to the sonobuoy, and the instrumentation for processing range information, as well as bearing, is avoided. Obviously, if the ranges of target and torpedo from the sonobuoy are both displayed, the command heading $H_c$ may be adjusted to correspond with the bearing $\beta_3$ from the torpedo to the target for steering the torpedo directly to the target.

It is also contemplated that right and left steering information may be transmitted directly to the enabling relay 58 instead of using command heading signals $H_c$. This technique obviously would avoid the need for the compass computer 57.

When the torpedo 17 reaches an acoustic range for acquiring the target and operating its own homing system, the nose transducer 22 output signal to a modulator/demodulator 59 reaches a strength sufficient to operate a threshhold generator 61 which produces a discrete signal through the modulator 53 for transmission by the transducer 24 to the TACO operator via the sonobuoy 18 thereby informing him that TACO command heading signals $H_c$ are no longer required. Upon torpedo homing acquisition, the guidance control circuit 44 now operates under the acoustic homing system of the torpedo. In the illustrated embodiment, the torpedo 17 acoustic homing system employs echo-ranging sound techniques and therefore includes a ping generator 62 having an output transformed by the modulator-demodulator 59 for producing a sound from the nose transducer 22. It will be observed that the enabling relay 58 operates so that should the torpedo 17 lose contact with the target during acoustic homing, the TACO station 12 may resume heading command.

Some of the many advantages of the present invention should now be apparent. For example, the invention contemplates three distinct phases of target acquisition: (1) a search phase which includes initial detection and localization of the target to obtain a position or fix to which an air-to-subsurface missile may be delivered, (2) an intermediate acquisition phase utilizing a directional sonobuoy having relatively high detection range capability for remotely steering the submerged torpedo toward the target, and (3) a terminal acquisition phase utilizing an acoustic homing capability in the torpedo for attacking the target. The present invention thereby effectively extends the acquisition range of an acoustic homing torpedo and increases the probability of "kill" irrespective of the expected operational "blind time" between the air launching and acquisition by the homing torpedo or of the speed of the submarine or surface vessel.

Other alternatives to the disclosed embodiment are contemplated. For example, instead of a ring transducer 23 mounted on the torpedo 17, a separate transducer may be trailed at some distance behind the torpedo to achieve acoustic isolation from noises which may be generated about the torpedo 17 as it travels in the water. Also, the TACO control guidance link from the sonobuoy to the torpedo may constitute a wire link in place of the sonar link and ring transducer 23.

It will be understood, of course, that various changes in the details, materials, steps and arrangement of parts which have been herein described and illustrated in order to explain the nature of the invention, may be by those skilled in the art within the principle and scope of the invention as expressed in the appended claims.

What is claimed is:

1. An air-to-subsurface missile system for use against high speed submarines and surface vessels, comprising:

an acoustic homing torpedo;

a directional sonobuoy positioned in tandem behind said torpedo; and cowling means removably connected to said torpedo and said sonobuoy forming thereby a rigid unitary aerodynamic missile, said cowling means including a pair of elongated semicircular casings abutting along the longitudinal edges and enveloping said torpedo and sonobuoy about the proximal ends thereof, securing means releasably connected to said casings and activated upon delivery of said missile to a desired position in water for jettisoning said casings, and fin means radially extending from said casings for providing aerodynamic stability to said missile.

2. A missile as set forth in claim 1 wherein said torpedo further comprises;

a frangible nose cone secured on the distal end having an aerodynamic profile and which is disintegratable upon impact with water thereby exposing a hydrodynamic profile of said torpedo at the distal end thereof.

3. Apparatus as set forth in claim 1 wherein said torpedo further comprises:

homing means including a directionally responsive homing transducer means to underwater sounds and having an output indicative of steering angle, guidance control means having one input connected to the steering angle output of said homing transducer means for steering said torpedo;

an omnidirectional transducer exposed at and flush with the outer surface of said torpedo for receiving acoustic signals indicative of a torpedo heading command;

demodulator means having an input connected to the output of said transducer means for producing a control signal at the output thereof;

compass computer means having an input connected to the output of said demodulator for measuring and subtracting the magnetic heading of said torpedo from the command heading input for producing a steering angle at the output thereof;

relay means having one input connected to the output of said compass and an output adapted to be connected to override the acoustic homing guidance controls of said torpedo when a steering command signal is received at said one input to said relay.

4. A missile as set forth in claim 3 wherein said torpedo further comprises:

an omnidirectional projector transducer means exposed on and flush with the surface of said torpedo for generating underwater sounds;

ping generator means having an intermittent pulse output signal; and modulator means operatively connected between said projector transducer and said generator means for driving said transducer at a discrete acoustical frequency at the intermittent pulse rate.

5. A missile as set forth in claim 4, wherein said torpedo further comprises:

a threshhold signal generator having an input connected to the output of said homing transducer and an output connected to the input of said modulator means for providing a discrete acoustical signal at said projector transducer when said homing means has positively acquired an underwater target.

6. A missile as set forth in claim 5 wherein said sonobuoy further comprises:

an annular float;

a directional hydrophone removably contained within said float;

cable means operatively connected between said float and said hydrophone and wound within said buoy for payout with said hydrophone; and means contained within said float for transforming acoustical signals to radio signals and for transforming radio signals to acoustic signals.

7. A missile as set forth in claim 6, further comprising:

a tactical command station which includes an RF transceiver for transmitting and receiving information to and from said sonobuoy, position computer means connected to the output of said transceiver for transforming and resolving said information at the output thereof, display means having an input connected to the output of said computer for displaying position information, and heading signal generator means having an output connected to the input of said transceiver for producing command heading signals for steering said torpedo.

8. A missile system as set forth in claim 6 wherein said tactical command station further includes:

search means having an output operatively connected to said display for indicating an initial target position.

* * * * *